United States Patent [19]

Tenuto, Jr. et al.

[11] Patent Number: 4,789,134

[45] Date of Patent: Dec. 6, 1988

[54] FORCIBLE ENTRY TOOL

[76] Inventors: John B. Tenuto, Jr., 210 Mockingbird La., Casselberry, Fla. 32707; Robert R. Hodge, 1038 Shaffer Trail, Oviedo, Fla. 32765; Arthur V. Williams, 1864 Sabal Palm Dr., Edgewater, Fla. 32032; Hans E. Karreman, 130 Bimini Rd., Cocoa Beach, Fla. 32931

[21] Appl. No.: 77,506

[22] Filed: Jul. 24, 1987

[51] Int. Cl.[4] ..... B66F 3/00

[52] U.S. Cl. ..... 254/104; 254/129; 254/130; 72/705

[58] Field of Search ..... 144/34 A, 34 B; 254/104, 129, 130, 123, 120, 132; 72/705; 29/239, 275

[56] References Cited

U.S. PATENT DOCUMENTS

| | | | |
|---|---|---|---|
| 1,960,255 | 5/1934 | Tyroff | 254/130 |
| 2,369,383 | 2/1945 | Williams et al. | 254/130 |
| 2,676,784 | 4/1954 | Howard | 254/130 |
| 2,690,323 | 9/1954 | Evenson | 144/34 A |
| 3,081,066 | 3/1963 | Murawski | 254/93 R |
| 3,254,876 | 6/1966 | Powell | 254/132 |
| 3,819,153 | 6/1974 | Hurst et al. | 72/705 |
| 4,030,700 | 6/1977 | Dushku | 144/34 A |
| 4,130,270 | 12/1978 | Andersson | 144/34 A |

*Primary Examiner*—Robert C. Watson

*Attorney, Agent, or Firm*—William M. Hobby, III

[57] ABSTRACT

A forcible entry tool apparatus is provided for use by firemen and the like for forcible entry into vehicles or structures to assist in rescue operations. The tool has a base with a prying foot movably attached to the base with a pin acting as a fulcrum point for movement of the prying foot. The handle is attached to the prying foot for moving the prying foot on the lever pin on the base and a stabilizing arm is removably attachable to the foot for bracing the foot while the handle is being operated to move the prying foot on the fulcrum pin. Both the handle and the stabilizing arm are telescoping members. The stabilizing arm has a bracing foot attached to one end and is attached to the base with a positioning bracket. The prying foot can have the fulcrum pin positioned at different points for different operations and the handle can be positioned in different positions relative to the foot for proper leverage for prying open doors and the like. The base may also have a striking plate formed thereon, as well as gripping teeth.

12 Claims, 2 Drawing Sheets

FORCIBLE ENTRY TOOL

BACKGROUND OF THE INVENTION

The present invention relates to emergency entry tools for use by firemen and the like in rescue operations and especially to a universal tool which can be utilized for car doors, buildings and windows.

In the past it has been commen for firemen or rescue vehicles to carry firemen axes or other special tools for forcing open the doors of buildings to gain access to a building and to use crowbars and the like for forcing open car doors. There are also a variety of power tools which can be utilized for gaining entry to a car or building for putting out a fire or rescuing victims trapped in the car or building. Accident victims are frequently trapped in a wrecked vehicle with the doors and windows frozen by the damage to the vehicle. The present tool allows for the prying of a door with greater leverage than is normally used and for a base and support arm to grip one surface while the door is being pried open. The tool also provides for a striking surface and a wide variety of adjustment for gripping different surfaces for greater leverage to avoid having to bring in welding torches and cutting shears for cutting into vehicles having injured passengers in the vehicle. There have also been a variety of combination tools used for prying, hammering and cutting for a variety of purposes.

Typical combination tools may be seen in the U.S. Pat. No. 3,694,918, to Bailey, et al., for a Metal Cutting Apparatus which fulcrums a cutting blade and allows the rescue operator to enter a vehicle. The Fried U.S. Pat. No. 3,219,316, and the Tarran U.S. Pat. No. 4,287,623, each shows forceful entry tools for use in rescue operations. In the U.S. Pat. No. 1,551,035, to Kurau, and Fry. U.S. Pat. No. 1,472,517, a wrecking tool is shown and includes gripping teeth thereon. The U.S. Pat. No. 3,710,407, to Reid shows a combination tool for opening wrecked vehicles. The McChesnie U.S. Pat. No. 1,397,644, shows a combination tool while the Jones U.S. Pat. No. 1,972,147, shows a roof hook tool for removing roofing material. The Perry U.S. Pat. No. 327,821, and the Stafford U.S. Pat. No. 2,482,805, each shows tools for opening containers.

The aim of the present invention is primarily to provide a manual tool for the forcible entry into vehicles and structures in a rapid and efficient manner which has a variety of universal adjustments for operating at different angles or positions and for different types of structures.

SUMMARY OF THE INVENTION

The present invention relates to a forcible entry tool for use by firemen, police, rescue vehicle and the like and has a base with a prying foot movable attached to the base with a fulcrum pin. A handle is attached to the prying foot for moving the prying foot on the fulcrum pin on the base. The handle is a telescoping to vary the leverage obtained on the prying foot. A stabilizing arm is removably attached to the foot for bracing the foot while the handle is operated to move the prying foot on the fulcrum pin. The stabilizing arm is removably attached to the base with a stabilizing arm positioning bracket which can be pinned in different positions and the stabilizing arm includes a movable bracing foot and is telescoping to different positions where it can be locked with a pin. The base includes a striking bar as well as positioning slots for positioning the prying foot fulcrum pin in different positions. The prying foot also has a handle positioning and locking the handle in different position. Gripping teeth are provided on the primary foot as well as on the base for gripping surfaces during a forcible entry operation.

BRIEF DESCRIPTION OF THE DRAWINGS

Other objects, features and advantages of the present invention will be apparent from the written description and the drawings in which.

THE DESCRIPTION OF THE PREFERRED EMBODIMENT

Figure 1:
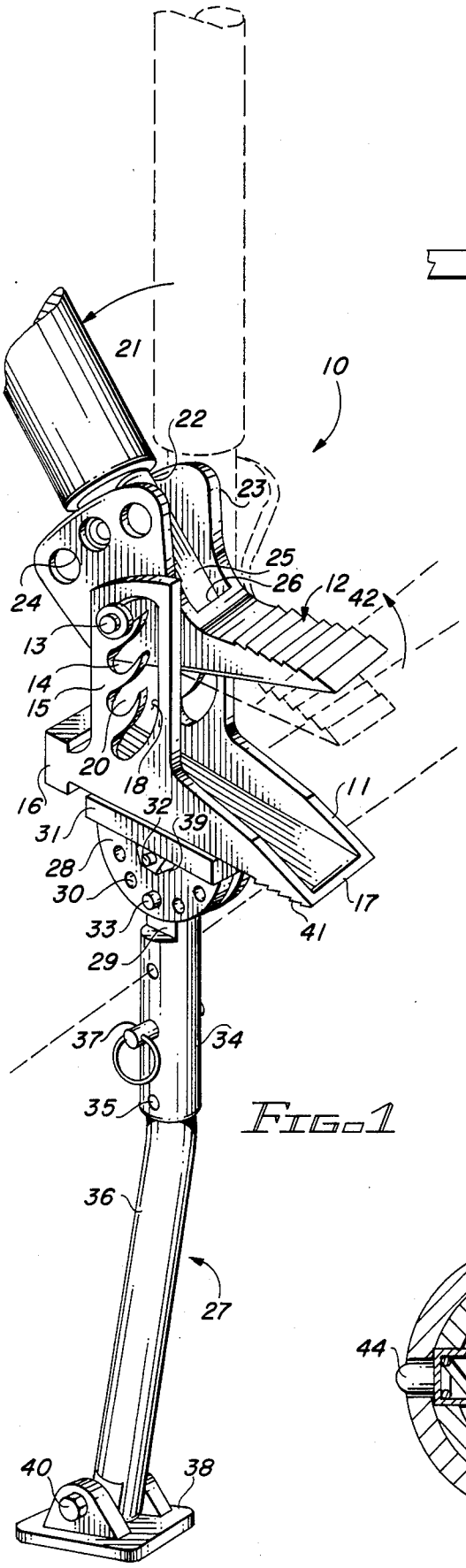
FIG. 1 is a perspective view of a forcible entry tool in accordance with the present invention.

Referring to FIGS. 1 through 5 of the drawings forcible entry tool 10 has a base 11 and a prying foot 12 having a fulcrum pin 13 positioned in one of a plurality of positioning slots 14 in a perpendicular extension 15 to the base 11. The base 11 has striking plate 16 on one end thereof and a sharpened end 17 at the other end thereof for striking and inserting the tool. The upright portion 15 of the base 11 has a vertical slot 18 with four angled slots 20 extending therefrom for sliding the fulcrum pin 13 thereunto for positioning for different surfaces. A handle 21 is a telescoping aluminum handle and has an attaching end 22 which fits in a handle yoke 23 extending from the prying foot 12. Each side of the yoke 23 has a plurality of apertures 24 for locking the handle bracket 22 therethrough to the yoke 23 in different positions. The end of the bracket 25 extends into a supporting shoe 26 in the prying foot 12. The base 17 has a stabilizing arm 27 attached thereto through a stabilizing arm positioning bracket 28. The bracket 28 has a plurality of apertures 30 there through and is attached to a base 31. The stabilizing arm 27 has an attaching portion 29 extending between the bracket portions 28 and is rotatably attached thereto with a pin 32 having a threaded end for a nut 33. The swinging stabilizing arm 27 can be locked in different positions with the locking pins 33 sliding into the apertures 30 to position the stabilizing arm for different forcible entry operations.

Figure 5:
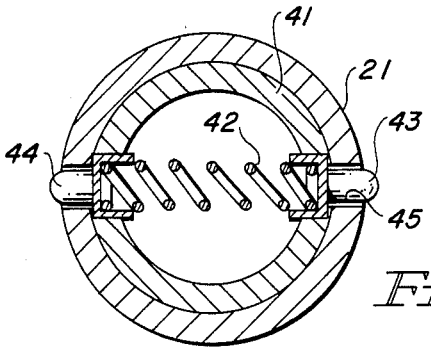
FIG. 5 is a sectional view taken on the line 5—5 on FIG. 4.
Figure 4:
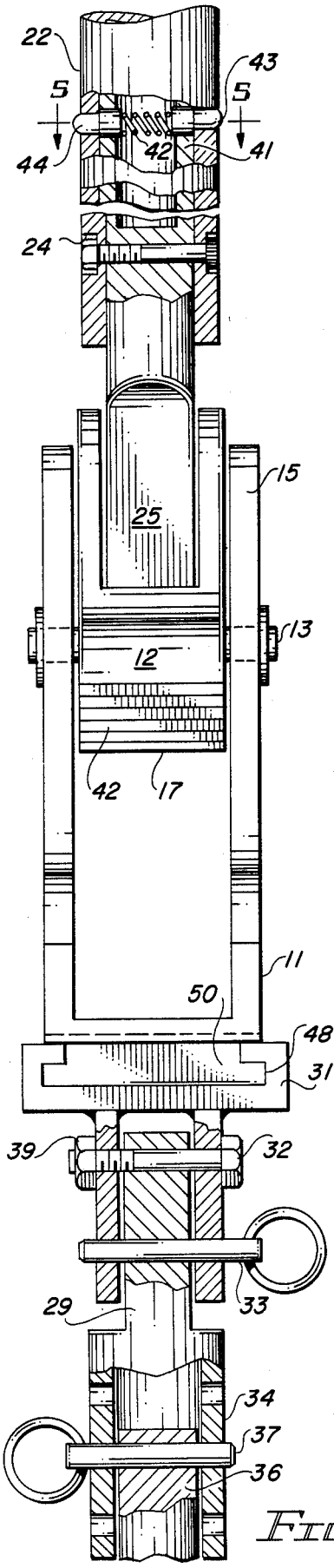
FIG. 4 is a sectional view of the prying tool of FIGS. 1, 2 and 3.

The stabilizing arm 27 includes the arm portion 34 having a plurality of apertures 35 therein for sliding a telescoing portion 36 therein. A telescoping portion 36 has a plurality of openings therein so that locking pins 37 can be inserted through the apertures 35 to lock the stabilizing arm portion 36 in different lengths. A stabilizing arm 27 extension portion 36 has a movable bracing foot 38 attached thereto with a pin 40 which allows a bracing foot to be put into different positions. The base 17 has a plurality of gripping teeth 41 thereunder for gripping a surface while the prying foot 12 has a plurality of gripping teeth 42 on the top thereof as seen in FIG. 5. The telescoping handle 21 has a telescoping portion 41 which has a spring 42 positioned therein to push against a pair of locking pins 43 and 44 which slides in the aperture 45 to lock the telescoping portion 41 in the handle 21.

Figure 2:
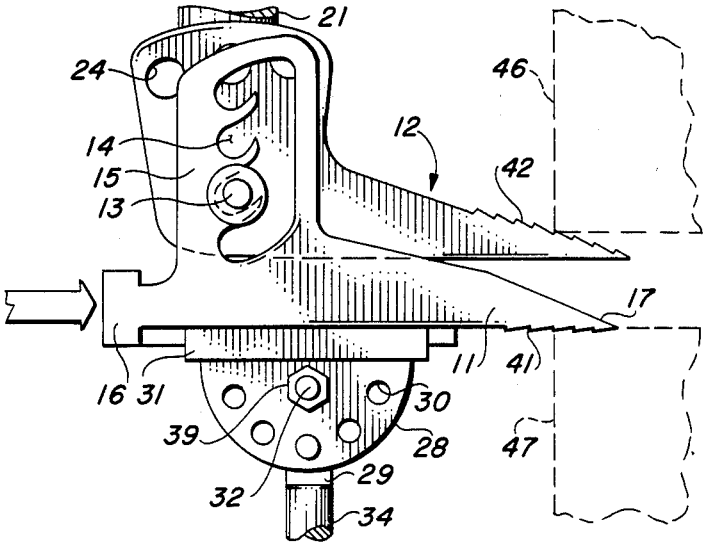
FIG. 2 is a side elevation of the forcible entry tool of figure one having the prying foot inserted between two surfaces.
Figure 3:
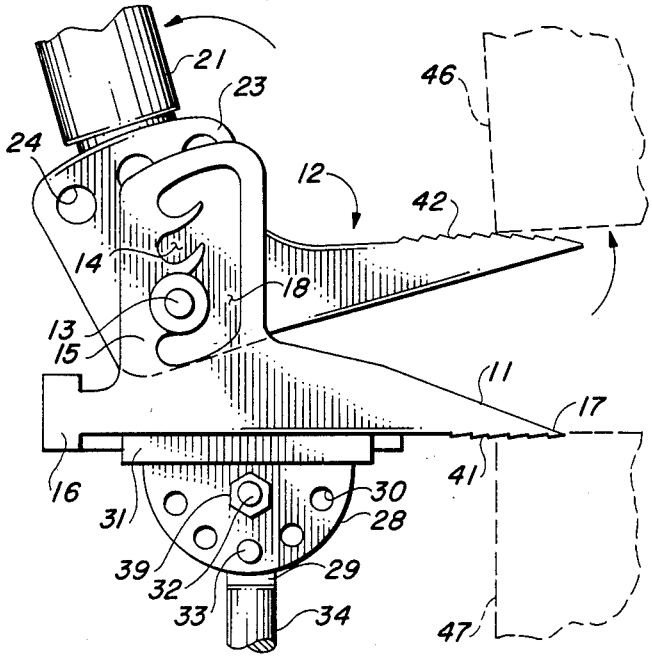
FIG. 3 is a side elevation in accordance with FIG. 2 with the surfaces pried apart.

The prying operation of the present tool is illustrated operated in connection with FIGS. 2 and 3 in which the pryiing foot 12 and the base 11 has been inserted between a pair of surfaces 46 and 47 with gripping teeth 41 and 42 against the surfaces 46 and 47. Once inserted, as shown in FIG. 2, with a stabilizing arm 27 bracing against the lower surface 47, rotation of the handle 21 pries the surfaces 46 and 47 apart. Adjustment to the tool may be done by sliding the pin 13 into different slots 14 and locking the handle in different apertures 24 for angular positioning of the handle and by adjusting the stabilizing arm 27 through different angular positions with the aperture 30 and the bracket 28 locked with the pin 33 in positioning brace foot 38. A wide variety of positions of the leverage tool may be made for different vehicles door, windows, as well as providing a striking plate 15 and a pointed striking plate with a base edge 17.

Figure 6:
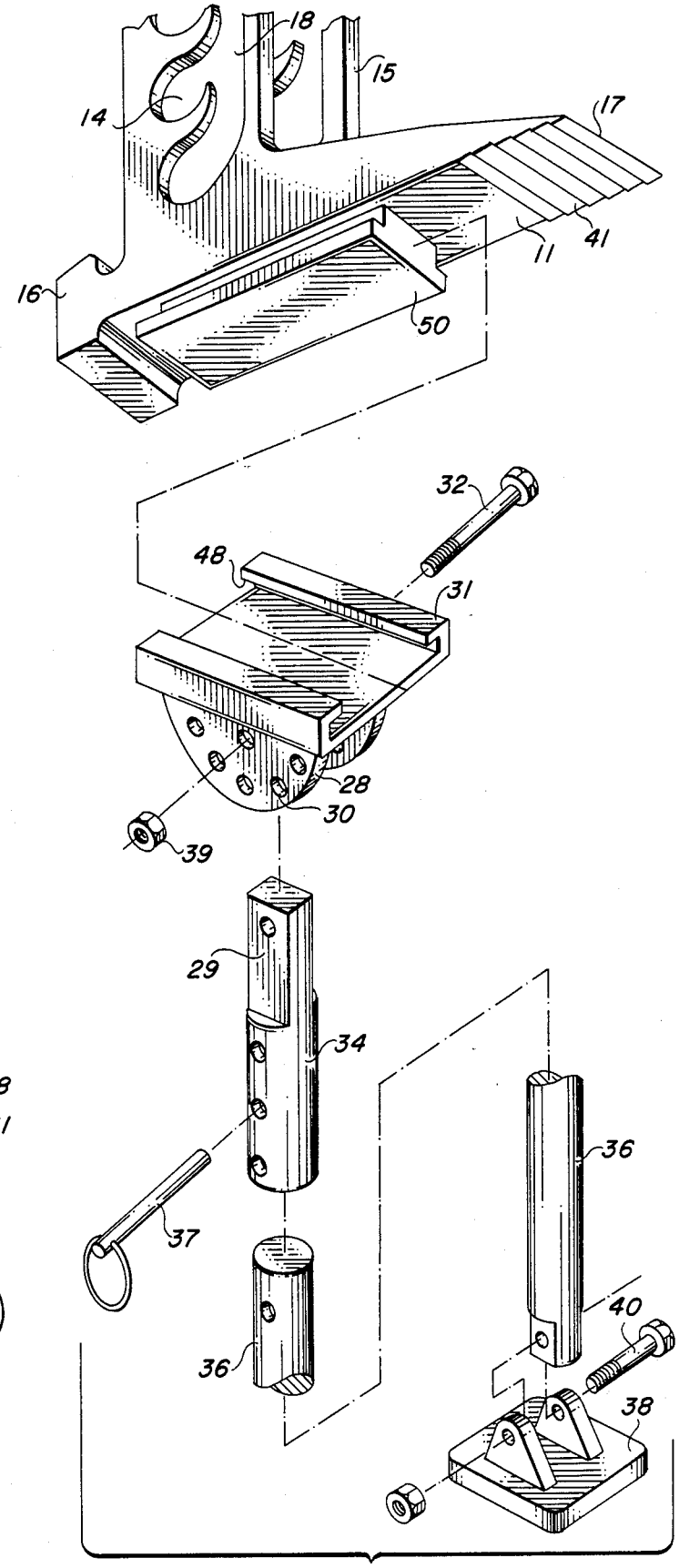
FIG. 6 is an exploded view of the forcible entry tool of FIGS. 1 through 5.

The stabilizing arm 27 can be removed as shown in the exploded view of FIG. 6 by removing the nut 39 from the pin 32 to remove the attaching portion 29 of the stabilizing arm. The stabilizing arm can be rapidly removed just by sliding off the base 31. Base 31 forms a pair of slots 48 for sliding in the track ledges 50 attached to base 11.

It should be clear at this point that a forcible tool has been provided which is universal in its prying operations and includes a striking surface and which can be quickly positioned for a wide variety of entry operations into wrecked vehicles, as well as into buildings. However, the present invention is not to be considered limited by the forms shown, which are to be considered illustrative rather than restrictive.

We claim:

1. A forcible entry tool comprising:

a base;

a prying foot movably connected to said base with a leverage pin;

a telescoping handle attached to said prying foot for moving said prying foot on said lever pin on said base; and a stabilizing arm removably attached to said foot for bracing said foot while said handle is operated to move said prying foot on said leverage pin; said stabilizing arm having a brace rotatably attached to one end thereof and said stabilizing arm having a stabilizer arm locking member having a plurality of locking positions thereon attaching said stabilizing arm to said base whereby said forcible entry tool can be braced with a plurality of leveraged positions while using said tool.

2. A forcible entry tool in accordance with claim 1 in which said stabilizing arm includes a telescoping member having adjustable positions.

3. A forcible entry tool in accordance with claim 2 in which said stabilizing arm has a pin for locking said telescoping member in different positions.

4. A forcible entry tool in accordance with claim 1 in which said stabilizing arm locking member is removably attached to said base with a fixed track attached to said base and having a slidable locking member sliding on said track, whereby said stabilizing arm slidable locking member can be slid off the track.

5. A forcible entry tool in accordance with claim 4 in which said stabilizing arm sliding locking member includes a pair of channels sliding on said fixed track attached to said forcible entry tool base.

6. A forcible entry tool in accordance with claim 5 in which said telescoping handle has attaching means for attaching said handle to said prying foot and said prying foot has an attaching yoke means attached to said prying foot for attaching said handle attaching means thereto and said attaching yoke means has a plurality of locking positions for locking said handle in different positions.

7. A forcible entry tool in accordance with claim 6 in which said prying foot attaching yoke means includes a plurality of apertures therein for positioning pins thereinto for locking said handle in a predetermined angular positions.

8. A forcible entry tool in accordance with claim 1 in which said base has a plurality of gripping teeth on one surface thereof.

9. A forcible entry tool in accordance with claim 8 in which said prying foot has a plurality of gripping teeth formed on one side thereof.

10. A forcible entry tool in accordance with claim 9 in which said prying foot has a sharpened edge on one end thereof.

11. A forcible entry tool in accordance with claim 10 in which said base has a sharpened edge on one end thereof.

12. A forcible entry tool in accordance with claim 11 in which said prying foot has a fulcrum pin attached thereto and said base has an extending prying foot attaching portion having a plurality of slots therein for attaching said prying foot in a plurality of positions for spacing said prying foot from said base at the fulcrum point in different spaced positions.

* * * * *